US005393047A

United States Patent [19]

Ahl et al.

[11] Patent Number: 5,393,047

[45] Date of Patent: Feb. 28, 1995

[54] SHEET GRIPPING MECHANISM

[75] Inventors: David K Ahl, Rochester; Eric A. Merz, Penfield; Timothy G. Struczewski, Rochester; Roger M. Swanson, Fairport; George F. Rittberg, Macedon, all of N.Y.

[73] Assignee: Xerox Corporation, Stamford, Conn.

[21] Appl. No.: 183,636

[22] Filed: Jan. 17, 1994

Related U.S. Application Data

[63] Continuation of Ser. No. 947,596, Sep. 21, 1992, abandoned.

[51] Int. Cl.[6] ..... B65H 5/00

[52] U.S. Cl. ..... 271/277; 271/204; 294/104

[58] Field of Search ..... 271/277, 204, 85, 206, 271/82; 101/408, 409; 198/803.7, 803.8, 803.9; 294/104

[56] References Cited

U.S. PATENT DOCUMENTS

| | | | |
|---|---|---|---|
| 1,462,923 | 7/1923 | Steven | 271/204 |
| 2,014,975 | 9/1935 | Meckler | 101/408 |
| 2,418,065 | 3/1947 | Bobst | 101/408 |
| 2,867,275 | 1/1959 | Laufer | 271/204 |
| 4,155,305 | 5/1979 | Heissler et al. | 101/408 |
| 4,592,279 | 6/1986 | Kemmerer | 101/412 |
| 4,629,176 | 12/1986 | Ceelen | 271/204 |
| 4,647,031 | 3/1987 | Smith et al. | 271/82 |
| 4,660,825 | 4/1987 | Umezawa | 271/277 |
| 4,693,362 | 9/1987 | Kemmerer et al. | 198/803.9 |
| 4,779,717 | 10/1988 | Eberle | 198/803.8 |
| 5,128,726 | 7/1992 | Cassano et al. | 355/308 |
| 5,151,745 | 9/1992 | Durland et al. | 271/277 |
| 5,201,516 | 4/1993 | Cherian et al. | 271/204 |
| 5,211,392 | 5/1993 | Swanson et al. | 271/204 |
| 5,227,854 | 7/1993 | Dastin et al. | 271/204 |

*Primary Examiner*—H. Grant Skaggs
*Attorney, Agent, or Firm*—Don L. Webber

[57] ABSTRACT

An apparatus for gripping the leading edge portion of a sheet includes a first gripping member which substantially spans the leading edge portion of the sheet. The apparatus further includes a spring having a portion thereof defining a second gripping member which substantially spans the leading edge portion of the sheet, the second gripping member being urged toward the first gripping member to grip the sheet.

5 Claims, 4 Drawing Sheets

SHEET GRIPPING MECHANISM

This is a continuation of application Ser. No. 07/947,596, filed Sep. 21, 1992, now abandoned.

CROSS REFERENCE

Cross reference is made to co-pending U.S. patent application Ser. Nos. 07/808,242 (abandoned), entitled, "Apparatus for Gripping a Sheet" by A. Cherian, R. Swanson and S. Reese, and 07/879,399 (issued on Apr. 13,1993 as U.S. Pat. No. 5,210,516), entitled, "Sheet Gripping Apparatus" by A. Cherian, R. Swanson and E. Merz, and both assigned to the same assignee as the present invention.

The present invention relates generally to an apparatus for gripping a sheet and, more particularly, concerns a sheet gripper for gripping the leading edge portion of a sheet and pulling it through the sheet path of a copying or printing machine.

Sheet grippers of various designs are commonly used in copying and printing machines, for gripping a sheet at its leading edge portion. The sheet gripper must hold the leading edge portion securely, but without causing damage thereto. Further, the sheet gripper must be structurally stiff without being overly heavy, complex, or expensive. The sheet gripper must open wide enough to allow easy entry of the sheet and then close on the sheet without requiring extensive machinery for this opening and closing process. Moreover, the sheet gripper must operate reliably through years of service. In addition, the sheet may have to be secured to the sheet gripper while a developed image is transferred to the sheet from a photoconductive member. As a result, the sheet gripper should be constructed so as to bring the sheet as close as possible to the photoconductive member so as to minimize deletion of any part of the image during the above transfer process.

The following disclosures relate to sheet grippers and therefore may be relevant to various aspects of the present invention.

U.S. Pat. No. 4,155,305 Patentee: Heissler et al. Issued: May 22, 1979

U.S. Pat. No. 4,592,279 Patentee: Kemmerer Issued: Jun. 3, 1986

U.S. Pat. No. 4,629,176 Patentee: Ceelen Issued: Dec. 16, 1986

U.S. Pat. No. 5,128,726 Patentee: Cassano et al. Issued: Jul. 7, 1992

U.S. Pat. No. 4,155,305 discloses a gripper carriage having a fiber sandwich construction. At least one layer of fibers is provided which may be in a sheet-type mode with two layers of fibers each having different directions of elongation, one layer having fibers extending in the longitudinal direction of the gripper carriage support, and the other layer having fibers extending crosswise to the longitudinal direction. Several manufacturing techniques can be utilized such as fiber winding and/or lamination of fiber strips or tubes.

U.S. Pat. No. 4,592,279 describes a sheet gripper which includes a clamp member adapted to be secured on a pivotable gripper shaft, and a gripper finger mounted resiliently on the clamp member and adapted to be brought into contact with a sheet to be gripped during pivoting of the gripper shaft. The clamp member is made of two sheet-metal parts and includes a base member and a bottom part, which are adapted to be hooked into engagement with one another on one side of the shaft and connected together by a mounting screw on the other side of the shaft to secure the clamp member on the gripper shaft. The gripper finger is also secured on the base member at one end by means of the mounting screw and is adjustable by means of a set screw threadably received in the base member approximately at the other end thereof. The gripper finger is made of spring steel and is pre-stressed to a specific spring force by means of a dimensioned recess and has a guide slot formed therein in which a lug formed on the base member is disposed to guide the gripper finger relative to the base member.

U.S. Pat. No. 4,629,176 discloses a paper gripper which includes upper and lower portions. The upper and lower portions are made from extruded aluminum and hinge together for their entire length. Two or three spring clips provide a bias for closing the bar.

U. S. Pat. No. 5,128,726 describes a sheet gripper which includes an upper gripping member and a lower gripping member. The sheet gripper also includes a plurality of springs to bias the upper gripping member toward the lower gripping member to grip the sheet.

In accordance with one aspect of the present invention, there is provided an apparatus for gripping the leading edge portion of a sheet. The apparatus includes a first gripping member which substantially spans the leading edge portion of the sheet. The apparatus further includes a spring having a portion thereof defining a second gripping member substantially spanning the leading edge portion of the sheet, the second gripping member being urged toward the first gripping member to grip the sheet.

Other features of the present invention will become apparent as the following description proceeds and upon reference to the drawings, in which.

Figure 1:
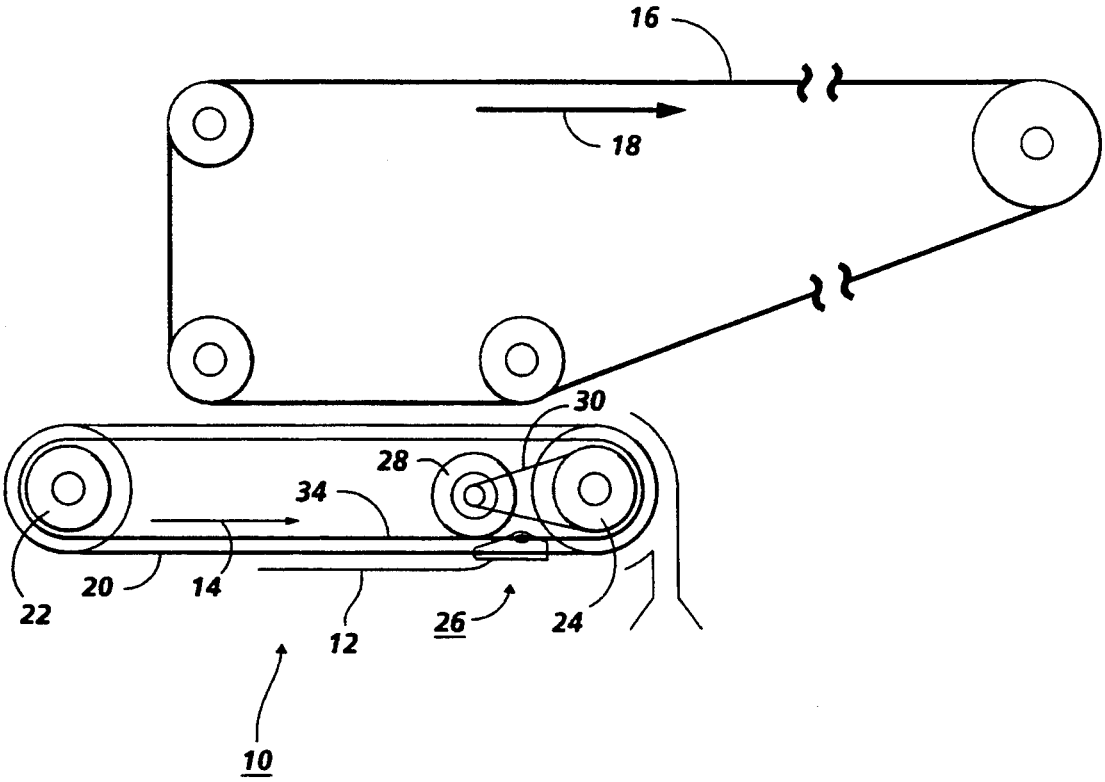
FIG. 1 is a schematic elevational view showing a sheet transport apparatus positioned adjacent to a photoconductive belt with the sheet transport apparatus incorporating the features of the present invention therein.

While the invention is susceptible to various modifications and alternative forms, a specific embodiment thereof has been shown by way of example in the drawings and will herein be described in detail. It should be understood, however, that it is not intended to limit the invention to the particular form disclosed, but on the contrary, the intention is to cover all modifications, equivalents, and alternatives falling within the spirit and scope of the invention as defined by the appended claims.

In FIG. 1 of the drawings, there is shown a sheet transport apparatus, generally indicated by the reference numeral 10. The sheet transport apparatus 10 is shown transporting a sheet 12 in the direction of arrow 14 in a recirculating path of movement. The sheet transport system 10 moves the sheet 12 during a portion of its travel into contact with a photoconductive belt 16 which is itself travelling in the direction of arrow 18. The above arrangement of the sheet transport apparatus 10 and photoconductive belt 16 may be used in an electrophotographic printing machine such as the printing machine described in U.S. Pat. No. 5,128,726 issued to Cassano et al., the disclosure of which is hereby incorporated by reference. In addition, the sheet transport apparatus 10 of the present invention has a configuration which is somewhat similar to the sheet transport apparatus described in the above Cassano et al. disclosure.

Figure 2:
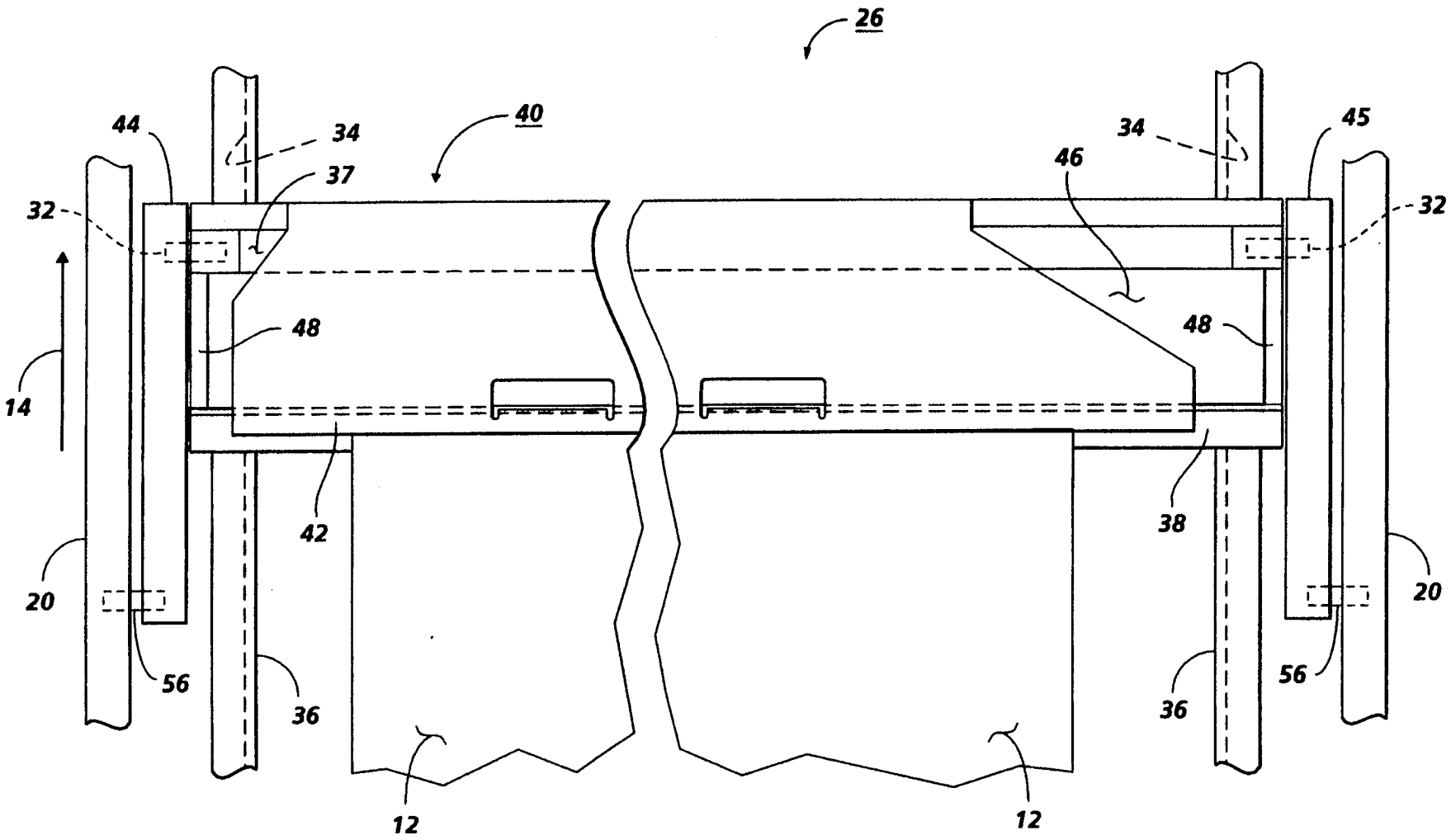
FIG. 2 is a fragmentary planar view showing the sheet gripper used in the sheet transport apparatus of FIG. 1 with the sheet gripper shown gripping the leading edge portion of a sheet.
Figure 4:
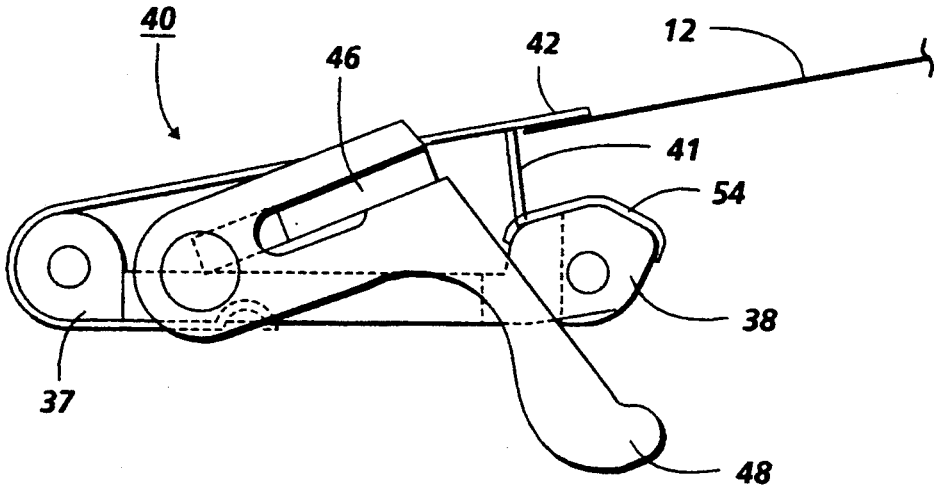
FIG. 4 is a side elevational view of the sheet gripper used in the sheet transport apparatus of FIG. 1 with the gripper ends removed for clarity of description and with the sheet gripper shown in the open position.
Figure 3:
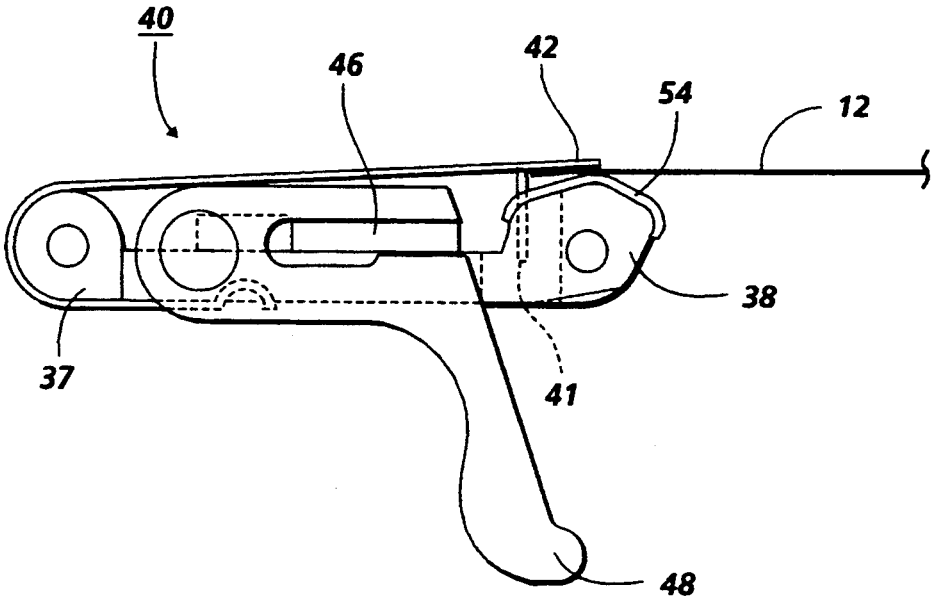
FIG. 3 is a side elevational view of the sheet gripper used in the sheet transport apparatus of FIG. 1 with the gripper ends removed for clarity of description and with the sheet gripper shown in the closed position.

The sheet transport apparatus 10 is described below in more detail with reference to FIGS. 1 and 2. In particular, the sheet transport apparatus 10 includes a pair of spaced apart timing belts 20 which are entrained about a pair of substantially cylindrical rollers 22 and 24. A motor 28 is coupled to the roller 24 by a drive belt 30. A sheet gripper, generally indicated by the reference numeral 26, extends between the belts 20 and moves in unison therewith. The belts 20 define a continuous path of movement of the sheet gripper 26. A pair of spaced apart and continuous tracks 34 are respectively positioned, near the belts 20. The tracks 34 are respectively defined by a pair of track supports 3. The sheet gripper 26 includes frame 37 which defines a lower gripping member 38. A silicone rubber coating 54 is positioned upon the lower gripping member 38. The frame 37 is connected to a pair of gripper ends 44 and 45. The belts 20 are respectively connected to the gripper ends 44 and 45 by a pair of pins 56. The belts 20 are connected to the sheet gripper 26 behind the leading edge of the sheet 12 relative to the forward direction of movement of the belts, as indicated by arrow 14, when the sheet 12 is being transported by the sheet transport apparatus 10. The sheet gripper 26 is driven by the belts 20 at the locations where the sheet gripper 26 and the belts 20 are connected. The sheet gripper 26 further includes a pair of guide members 32. Each of the guide members 32 are secured to a respective gripper end. Each of the guide members 32 are slidably positioned within a respective track 34. The sheet gripper 26 additionally includes a spring, generally indicated by the reference numeral 40. The spring 40 has a portion thereof which defines an upper gripping member 42. The upper gripping member has a thickness which is less than 0.0200 inch and greater than 0.0010 inch. Preferably the upper gripping member has a thickness of 0.0055 inch. The upper gripping member 42 is spring biased toward the lower gripping member 38 to grip the sheet 12 as shown in FIGS. 2 and 3. The spring 40 includes a plurality of stops 41 for registering the leading edge portion of the sheet within the sheet gripper 26. The spring 40 further includes a plurality of fingers F1–F10 as shown in FIG. 6 (see also FIG. 5). The spring 40 is made from sheet metal and the sheet metal is preferably beryllium copper. Alternately, the sheet metal may be steel. The spring 40 is secured around a portion of the frame 37 as shown in FIGS. 2–4. To ensure that the spring 40 remains secured to the frame 37, each of the fingers F1–F10 has a U-shaped end portion which fits into a cooperating recess defined within the frame 37 (see FIGS. 3 and 4).

Figure 5:
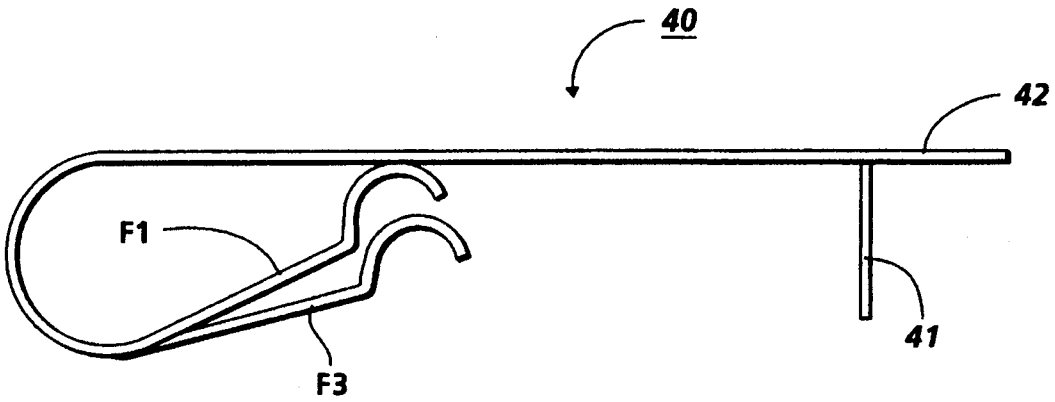
FIG. 5 is a side elevational view of the spring of the sheet gripper used in the sheet transport apparatus of FIG. 1.
Figure 6:
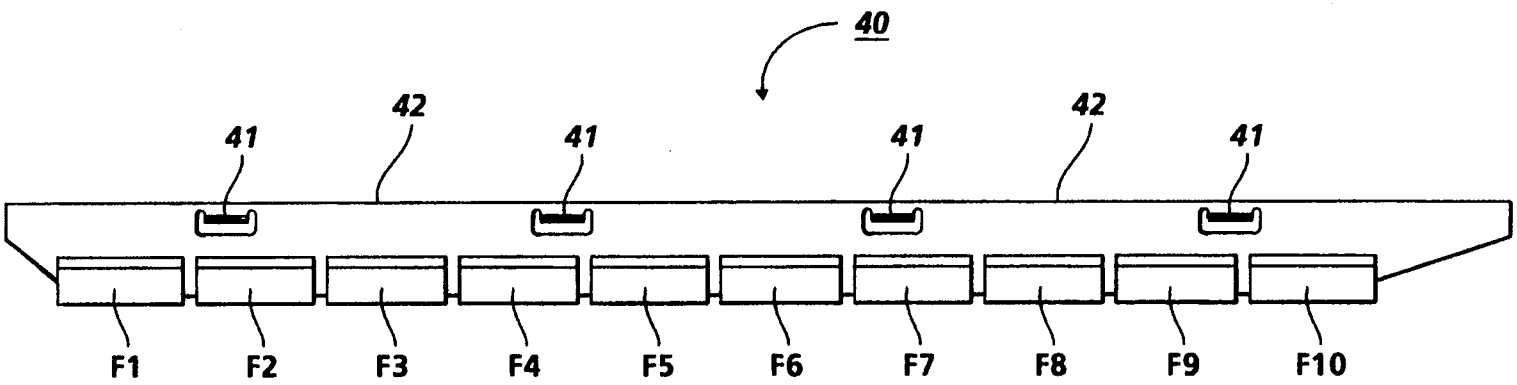
FIG. 6 is a reduced fragmentary planar view showing the underside of the spring of the sheet gripper used in the sheet transport apparatus of FIG. 1.

Fingers F1, F2, F9 and F10 are formed so as to contact the underside of spring 40 as exemplified by finger F1 shown in FIG. 5. Fingers F3, F4, F5, F6, F7 and F8 are formed so as to be spaced apart from the underside of spring 40 as exemplified by finger F3 shown in FIG. 5. The purpose for configuring the fingers F1–F10 as stated above, is to provide a higher grip force between the upper gripping member 42 and the lower gripping member 38 at the lateral end portions thereof when the spring 40 is secured around the frame 37 as shown in FIGS. 2–4. If it is desired to provide a higher grip force to a sheet with a width narrower than the width of sheet 12, an intermediate finger (e.g. finger F7) may be formed so as to contact the underside of spring 40 in a manner similar to the finger F1.

The sheet gripper 26 further includes a support 46 and a pair of cam followers 48 (only one cam follower is shown in FIGS. 3 and 4). The cam followers 48 are respectively attached to the opposed side marginal regions of the support 46 and function with a pair of cams (not shown) to open and close the gripping members at predetermined intervals. More specifically, when the cam followers 48 are not in contact with the cams, the spring bias of spring 40 urges the upper gripping member 42 toward the lower gripping portion 38 to grip sheet 12 therebetween as shown in FIG. 3. However, when the cam followers 48 contact the cams, the support 46 is moved in relation to the lower gripping member 38 from a first position as shown in FIG. 3 to a second position as shown in FIG. 4. As the support 46 moves from the first position to the second position, the support 46 contacts the spring 40 to urge the upper gripping member 42 away from the lower gripping member 38. The lower gripping member 38, the upper gripping member 42, support 46 and spring 40 each spans the leading edge portion of sheet 12 as shown in FIG. 2. In the closed position, the upper gripping member 42 cooperates with the lower gripping member 38 to grasp and securely hold the sheet 12 along its leading edge portion as shown in FIG. 2. In other words, the sheet 12 is grasped at the leading edge of the sheet along the entire width thereof. By having the spring 40 apply a grip force at substantially each point along the leading edge portion of the sheet 12 as shown in FIG. 2, the sheet gripper achieves a high grip force while being fairly insensitive to the straightness of the lower gripping portion 38.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

We claim:

1. An apparatus for gripping the leading edge portion of a sheet, comprising:

a first gripping member substantially spanning the leading edge portion of the sheet;

a spring having a portion thereof defining a second gripping member, said second gripping member substantially spanning the leading edge portion of the sheet, said spring urging the second gripping member towards said first gripping member to grip the edge of the sheet; and a support moveable in relation to said first gripping member between a first position and a second position, said support contacting said spring to urge said second gripping member away from said first gripping member as said support is moved from the first position to the second position, wherein said support substantially spans the leading edge portion of the sheet.

2. The apparatus of claim 1, wherein said second gripping member of said spring has a thickness of less than 0.0200 inch and greater than 0.0010 inch.

3. The apparatus of claim 1, further comprising a frame, said first gripping member being defined by a portion of said frame.

4. The apparatus of claim 3, wherein said spring is secured around another portion of said frame.

5. The apparatus of claim 1, wherein said first gripping member includes a friction enhancing coating positioned to contact the leading edge portion of the sheet when the sheet is gripped between said first gripping member and the second gripping member.

* * * * *